US007125324B2

(12) United States Patent
Palmgren et al.

(10) Patent No.: US 7,125,324 B2
(45) Date of Patent: Oct. 24, 2006

(54) INSULATED PAD CONDITIONER AND METHOD OF USING SAME

(75) Inventors: Gary M. Palmgren, Lake Elmo, MN (US); Brian D. Goers, Minneapolis, MN (US); Douglas J. Pysher, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 10/797,890

(22) Filed: Mar. 9, 2004

(65) Prior Publication Data

US 2005/0202676 A1 Sep. 15, 2005

(51) Int. Cl.
*B24B 7/00* (2006.01)
*B24B 9/00* (2006.01)

(52) U.S. Cl. ..... 451/177; 257/E21.002; 438/692; 451/444

(58) Field of Classification Search ..... 438/692, 438/691, 690; 451/8, 177, 444; 257/E21.002, 257/E21.216
See application file for complete search history.

(56) References Cited

U.S. PATENT DOCUMENTS

| | | | | |
|---|---|---|---|---|
| 5,196,353 | A | 3/1993 | Sandhu et al. | |
| 5,531,635 | A | 7/1996 | Mogi et al. | |
| 5,637,031 | A | 6/1997 | Chen | |
| 5,807,165 | A | 9/1998 | Uzoh et al. | |
| 5,911,619 | A | 6/1999 | Uzoh et al. | |
| 6,001,008 | A | 12/1999 | Fujimori et al. | |
| 6,066,030 | A | 5/2000 | Uzoh | |
| 6,123,612 | A * | 9/2000 | Goers | 451/540 |
| 6,176,992 | B1 | 1/2001 | Talieh | |
| 6,263,605 | B1 | 7/2001 | Vanell | |
| 6,379,223 | B1 | 4/2002 | Sun et al. | |
| 6,494,765 | B1 * | 12/2002 | Gitis et al. | 451/5 |
| 6,517,424 | B1 | 2/2003 | Wielonski et al. | |
| 6,540,597 | B1 * | 4/2003 | Ohmori | 451/443 |
| 6,648,731 | B1 | 11/2003 | Shin | |
| 6,666,754 | B1 | 12/2003 | Beckage | |
| 6,722,948 | B1 | 4/2004 | Berman | |
| 6,848,970 | B1 * | 2/2005 | Manens et al. | 451/5 |
| 2002/0042200 | A1 * | 4/2002 | Fawcett | 438/692 |
| 2003/0178320 | A1 * | 9/2003 | Liu et al. | 205/640 |
| 2004/0053560 | A1 * | 3/2004 | Sun et al. | 451/36 |
| 2005/0145484 | A1 * | 7/2005 | Basol et al. | 204/247.2 |

FOREIGN PATENT DOCUMENTS

| | | |
|---|---|---|
| WO | WO 99/26758 | 6/1999 |
| WO | WO 00/26443 | 5/2000 |
| WO | WO 00/59682 | 10/2000 |

* cited by examiner

*Primary Examiner*—Caridad Everhart
(74) *Attorney, Agent, or Firm*—Daniel D. Biesterveld

(57) ABSTRACT

A wafer planarization process with a conditioning tool having an electrical insulator that electrically insulates the abrasive surface of the conditioning tool. The electrical insulator extends the useful life of the abrasive surface of the conditioning tool by reducing the level of electrochemically driven corrosion.

11 Claims, 2 Drawing Sheets

INSULATED PAD CONDITIONER AND METHOD OF USING SAME

BACKGROUND

The present invention relates generally to polishing processes, particularly the planarization process used in the manufacturing of semiconductor devices. More particularly, the present invention relates to a planarization process having an electrically insulated pad conditioner.

During manufacture, semiconductor wafers used in semiconductor fabrication typically undergo numerous processing steps, including deposition, patterning, and etching steps. Details of these manufacturing steps for semiconductor wafers are reported by Tonshoff et al., "Abrasive Machining of Silicon", published in the *Annals of the International Institution for Production Engineering Research*, (Volume 39/2/1990), pp. 621–635. In each manufacturing step, it is often necessary or desirable to modify or refine an exposed surface of the wafer in order to prepare the wafer for subsequent fabrication or manufacturing steps.

One method of modifying or refining exposed surfaces of a wafer involves treating the wafer surface with a slurry containing a plurality of loose abrasive particles dispersed in a liquid. Typically, this slurry is applied to a polishing pad and the wafer surface is then moved against the pad in order to remove or take material off of the wafer surface. The slurry may also contain agents that chemically react with the wafer surface. This type of process is commonly referred to as a chemical-mechanical planarization or polishing (CMP) process.

A variation of CMP, electro-chemical-mechanical planarization or polishing (ECMP), adds electrical current flow through an electrolytic solution and the surface of the workpiece. See, for example, U.S. Pat. No. 5,911,619 (Uzoh et al.), which describes methods for planarizing the surface of a wafer by combining chemical mechanical planarization with electrochemical planarization methods.

Electro-chemical mechanical deposition (ECMD) methods and equipment have also been described in the art. See, for example, U.S. Pat. No. 6,176,992 (Talieh), which describes a method for simultaneously depositing and polishing a conductive material on a wafer. Electrical current can also be used in a wafer planarization process for other purposes, such as, for example, detecting the end point of a processing step.

One problem with CMP, ECMP, ECMD, and other wafer planarization and polishing processes is that the process must be carefully monitored in order to achieve a desired wafer surface topography. The use history of the polishing pad, for example, may affect the polishing results. The polishing pad surface is conditioned so that it is maintained in a proper form.

The polishing pad is conditioned with an abrasive article commonly referred to as a pad conditioner. After repeated conditioning steps, the pad conditioner eventually becomes incapable of conditioning the polishing pad at a satisfactory rate and uniformity. The highly corrosive environment in which the pad conditioners are frequently used can accelerate the rate at which the pad conditioners become spent.

Replacement of a spent pad conditioner in a wafer processing system can negatively impact productivity and create undesirable changes to the wafer processing conditions. Accordingly, the efficiency of a wafer planarization process can be increased if the useful life of the pad conditioner can be increased. Similar considerations apply to other slurry and fixed abrasive polishing processes.

SUMMARY

In addition to other corrosive elements, electrical current flowing through the pad conditioner can cause electrochemically driven corrosion. The electrical current may be introduced to the wafer process intentionally, such as, for example, in an ECMP or ECMD process. The introduction of electrical current may also be unintentional, such as, for example, in a CMP process with a stray current path.

The present invention provides an electrically insulated abrasive surface. More particularly, the present invention provides a wafer planarization process with a conditioning tool with an electrical insulator that electrically insulates the abrasive surface of the conditioning tool. The electrical insulator extends the useful life of the abrasive surface of the conditioning tool by reducing the level of electrochemically driven corrosion.

In one aspect, the present invention provides a wafer planarization system having an electrical source with a first electrode and a second electrode. The wafer planarization system has a polishing pad carrier connected to the first electrode and a workpiece carrier connected to the second electrode. A conditioning tool having an abrasive surface conditions the polishing pad. The abrasive surface of the conditioning tool is electrically insulated from at least one of the electrodes with an electrical insulator. In certain embodiments, the conditioning tool has the electrical insulator.

In another aspect, the wafer planarization system is an electro-chemical planarization system. The electro-chemical planarization system has a polishing pad carrier connected to the cathode and a workpiece carrier connected to an anode. A conditioning tool having an abrasive surface conditions the polishing pad. The abrasive surface of the conditioning tool is electrically insulated from at least one of the electrodes with an electrical insulator.

In another aspect, the conditioning tool has an electrically insulated conditioning disk having an abrasive surface and a substrate. The conditioning disk can have a carrier affixed to the substrate. The carrier can be an electrical insulator.

Also provided are methods for conditioning an electro-chemical-mechanical polishing pad. The methods include electrically insulating an abrasive surface of a conditioning tool. The abrasive surface is placed in contact with the polishing pad and moved relative to the polishing pad.

In another aspect of the present invention, methods are provided for planarizing a first side of a wafer. The methods include providing a moving polishing pad. The first side of a wafer is placed in contact the polishing pad. Electrical current is then caused to flow through the first side of the wafer. An abrasive surface of a conditioning tool that is electrically insulated from the electrical current is placed in contact with the polishing pad.

The above summary is not intended to describe each disclosed embodiment or every implementation of the present invention. The figures and the detailed description that follow more particularly exemplify illustrative embodiments.

DETAILED DESCRIPTION

The present invention provides an electrically insulated abrasive surface. More particularly, the present invention provides a wafer planarization process with a conditioning tool with an electrical insulator that electrically insulates the abrasive surface of the conditioning tool. The electrical insulator extends the useful life of the abrasive surface of the conditioning tool by reducing the level of electrochemically driven corrosion.

The term "electrically insulated," as used in this application, is a relative term meaning that essentially no electrical current flows from a referenced electrical source to the identified item. For example, an abrasive surface is "electrically insulated" if it has no electrical connection with a referenced electrical source. The electrical connection can be formed by any means, including, for example, a wire, a conductive fluid, a metal plate or fastener, conductive abrasive particles, a conductive metal matrix, and combinations thereof. An abrasive surface is also considered "electrically insulated" from an electrical source if it is electrically connected to only one electrode of the electrical source and there is essentially no potential difference (i.e. less than about 100 mV) between the abrasive surface and any other electrical source connected to the abrasive surface. In other words, an abrasive surface is "electrically insulated" if essentially no electrical current from a referenced electrical source can flow through the abrasive surface.

Figure 1:
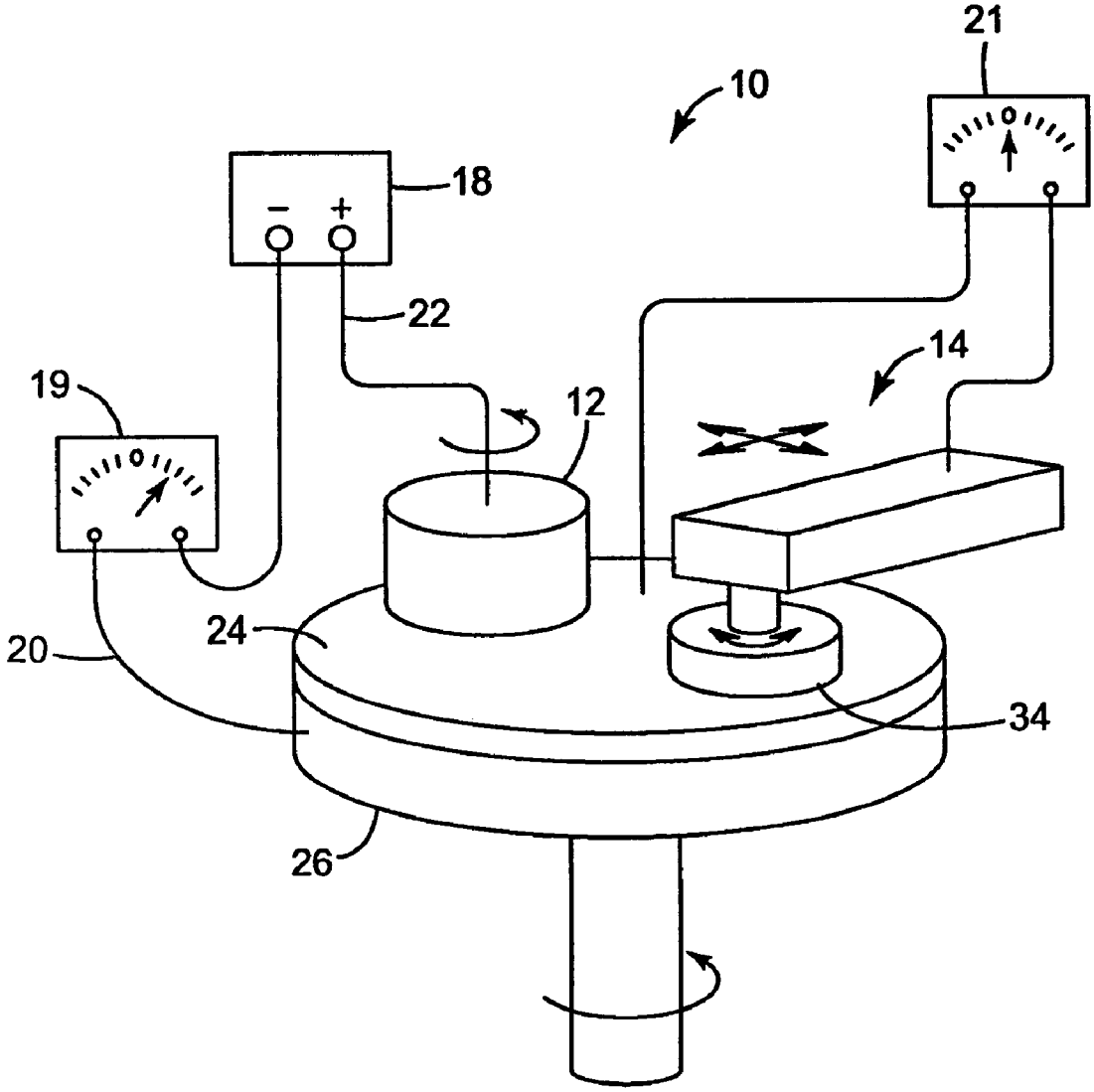
FIG. 1 is a schematic view of an exemplary electrochemical-mechanical planarization system with an electrically insulated pad conditioner.

FIG. 1 shows a schematic view of an exemplary electrochemical-mechanical planarization system 10 with an electrically insulated conditioning tool 14. As shown in FIG. 1, a wafer carrier 12 is moved relative to the polishing pad 24 to modify the surface of a wafer held by wafer. carrier 12. The polishing pad 24 is affixed to a polishing pad carrier 26. An electrical source 18 having a first electrode 20 and a second electrode 22 is used to produce an electrical current through the workpiece, indicated schematically by ammeter 19. The first electrode is typically connected to the polishing pad carrier 26 and conductive fluid is used to flow electrical current to the surface of the polishing pad 24 and to the workpiece.

The polishing pad 24 is conditioned by conditioning tool 14. Conditioning tool 14 includes a conditioning disk 34 in contact with the polishing pad 24. Ammeter 21 indicates schematically that there is essentially no electrical current flowing between the surface of the polishing pad 24, including any conductive fluids in contact with the polishing pad 24, and the conditioning tool 14. In other words, the conditioning tool 14 is electrically insulated from any current flowing through the workpiece.

In an electro-chemical mechanical planarization process, for example, the first electrode 20 will be a cathode (i.e. connected to the negative post of the electrical source) and the second electrode 22 will be an anode (i.e. connected to the positive post of the electrical source). In other configurations, the polarity can alternate or be reversed. In a plating step, for example, the first electrode 20 will be the anode and the second electrode 22 will be the cathode.

Figure 2:
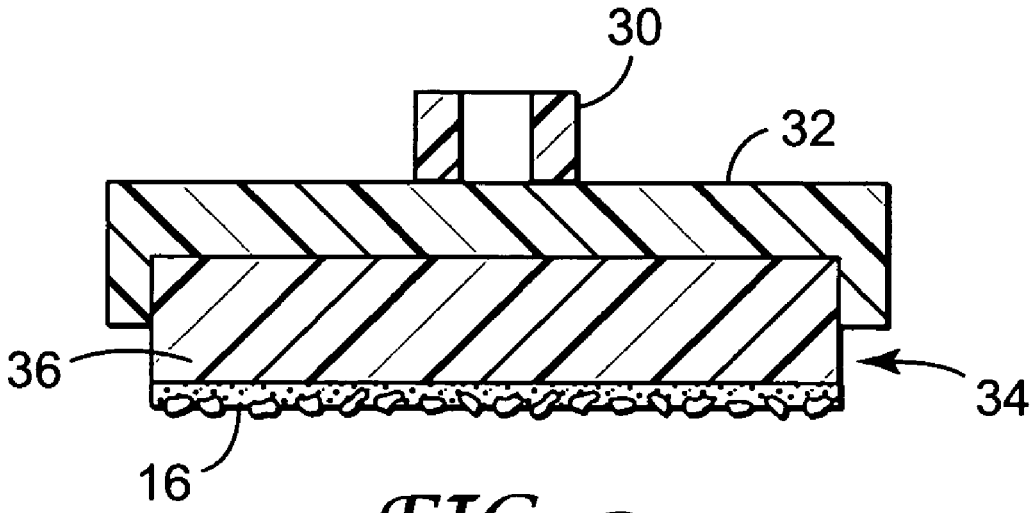
FIG. 2 is a cross-sectional side view of an exemplary conditioning disk assembly.

FIG. 2 shows a cross-sectional side view of an exemplary conditioning disk assembly. The conditioning disk assembly includes a conditioning disk 34 mounted in a conditioning disk holder 32. The conditioning disk holder 32 is attached to the conditioning tool 14 with a mounting chuck 30. The conditioning disk 34 includes an abrasive surface 16 on a substrate 36.

The abrasive surface 16 is a textured surface suitable for conditioning a polishing pad. The abrasive surface, for example, can include abrasive particles and a matrix material, such as described in U.S. Pat. No. 6,123,612 (Goers), incorporated herein by reference. Other techniques known in the art, including, for example, electroplating, sintering, and brazing can also be used to adhere the abrasive particles to a backing to create an abrasive surface.

The size and type of abrasive particles are selected based on the intended application. Suitable abrasive particles include, for example, fused aluminum oxide, ceramic aluminum oxide, heat treated aluminum oxide, silicon carbide, boron carbide, tungsten carbide, alumina zirconia, iron oxide, diamond (natural and synthetic), ceria, cubic boron nitride, garnet, carborundum, boron suboxide, and combinations thereof. In certain preferred embodiments, the abrasive particles have a Mohs hardness of at least about 8. In other embodiments, the Mohs hardness is at least about 9. In yet other embodiments, the Mohs hardness is at least about 10.

Abrasive particles useful in the present invention have an average size of at least about 3 micrometers. In certain embodiments, the abrasive particles have an average size of at least about 20 micrometers. In other embodiments, the abrasive particles have an average size of at least about 40 micrometers. In yet further embodiments, the abrasive particles have an average size of at least about 80 micrometers. Abrasive particles useful in the present invention have an average size of less than about 1000 micrometers. In certain embodiments, the abrasive particles have an average size less than about 600 micrometers. In other embodiments, the abrasive particles have an average size less than about 300 micrometers.

In certain embodiments, the abrasive particles may be in the form of abrasive agglomerates that comprise a plurality of individual abrasive particles bonded together to form a unitary particulate. The abrasive agglomerates may be irregularly shaped or may have a predetermined shape. The abrasive particles may further include a surface treatment, such as, for example, a coupling agent, or a metal or ceramic coating.

The matrix material used in the abrasive layer to affix the abrasive particles can include a metal, such as, for example, tin, bronze, silver, iron, and alloys or combinations thereof. The matrix material may also include other metals and metal alloys, including, for example, stainless steel, titanium, titanium alloys, zirconium, zirconium alloys, nickel, nickel alloys, chrome, and chrome alloys. The substrate 36 can be made of any suitable material, such as, for example, stainless steel foil, nickel, or nickel-chromium-iron alloys available under the trade designation "INCONEL", available from McMaster-Carr Supply Co., Chicago, Ill.

The abrasive surface 16 is electrically insulated from at least one of the first and second electrodes, 20 and 22, respectively. In certain preferred embodiments, the abrasive surface is electrically insulated from each of the first and second electrodes, 20 and 22. The abrasive surface can be electrically insulated by, for example, affixing the abrasive surface to an electrically insulated substrate 36, an electrically insulated carrier 40, or an electrically insulated conditioning tool 14.

Various materials and combination of materials can be used to electrically insulate an object, including, for example, plastic, rubber, wood, paper, cork, glass, ceramic, and the like. For example, affixing an abrasive surface to a non-conductive plastic substrate can electrically insulate the abrasive surface.

In certain embodiments, the abrasive surface is electrically insulated by means of a conditioning disk 34 that is electrically insulated from at least one of the first and second electrodes, 20 and 22, respectively. In certain embodiments, the conditioning disk is electrically insulated from each of the first and second electrodes, 20 and 22. The conditioning disk can be electrically insulated by means of an electrically insulated conditioning disk holder 32, an electrically insulated mounting chuck 30, or an electrically insulating conditioning tool 14. The mounting chuck 30, for example, can be made of non-conductive plastic.

In yet further embodiments, the abrasive surface is electrically insulated by means of a conditioning tool 14 that is electrically insulated from at least one of the first and second electrodes, 20 and 22, respectively. In certain embodiments, the conditioning tool is electrically insulated from each of the first and second electrodes, 20 and 22. The conditioning tool can be electrically insulated from either of the first and second electrodes by, for example, using an electrically insulating material or combination of materials to affix the conditioning tool to its support. For example, the conditioning tool can be mounted with non-conductive rubber or plastic supports.

Figure 3:
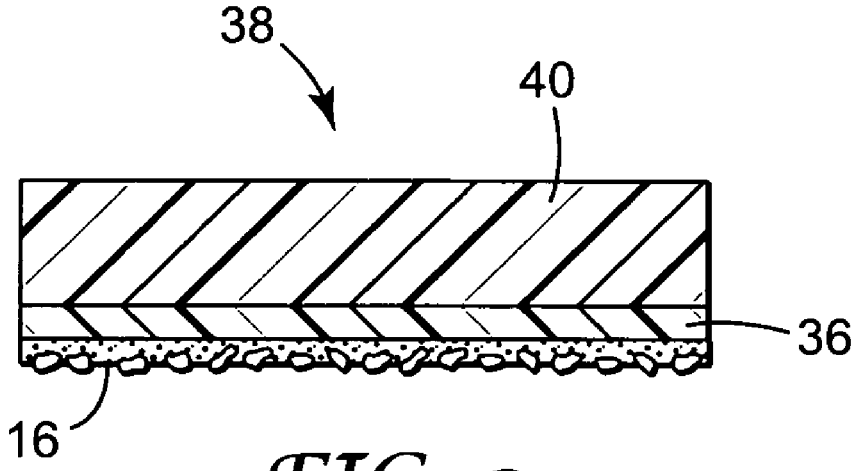
FIG. 3 is a cross-sectional side view of an exemplary conditioning disk having a carrier.

FIG. 3 is a cross-sectional side view of an exemplary conditioning disk 38 having a carrier 40. As shown in FIG. 3, the conditioning disk 38 includes an abrasive surface 16 affixed to a substrate 36 that is affixed to a carrier 40. In certain preferred embodiments, the carrier is an electrically insulating material, such as for, example, a plastic or a rubber. In certain preferred embodiments, the carrier is made from polycarbonate. The carrier can also be made from other materials including, for example, ceramics, filled and unfilled plastics such as epoxy, polysulfone, phenolics, polyacrylates, polymethacrylates, polyolefins, styrene, and combinations thereof. In other embodiments, the carrier is a metal, such as, for example, stainless steel.

Advantages and other embodiments of this invention are further illustrated by the following examples, but the particular materials and amounts thereof recited in these examples, as well as other conditions and details, should not be construed to unduly limit this invention. For example, the abrasive layer can be integral with the substrate or can be affixed to the substrate. All parts and percentages are by weight unless otherwise indicated.

COMPARATIVE EXAMPLE 1

A diamond pad conditioner, obtained from 3M of St. Paul, Minn., under the designation A160 and part number 60-9800-3429-6, was used to condition a polishing pad on a CMP machine without electrically insulated the abrasive layer of the pad conditioner. After a period of use, the pad conditioner exhibited corrosion.

COMPARATIVE EXAMPLE 2

A diamond pad conditioner, obtained from 3M of St. Paul, Minn., under the designation A160 and part number 60-9800-3429-6, was heated to soften the adhesive bonding the abrasive element to the stainless steel base plate. A spatula was used to remove the diamond abrasive element that was then trimmed to about 3.8 cm by 10 cm. The abrasive strip was submerged in an uncovered beaker containing 0.75 molar phosphoric acid, 3.75% hydrogen peroxide, and sufficient sodium hydroxide to raise the pH to 2.0. The abrasive strip was connected to the positive output of a constant current power supply. A secondary nickel electrode was also placed in the beaker and a 1.0 amp current was passed through the resulting cell. As the test was allowed to run for about 16 hours evaporation reduced the area of the abrasive strip exposed to the current and increased both the concentration of the electrolyte and the current density. The top of the plate, where the current density was lowest, was green and showed some loss of the metal matrix surrounding the diamonds. Near the bottom of the plate, in the region of highest current density, the metal matrix and diamonds were gone and the substrate supporting them had started to dissolve. The initial green corrosion product resembled the corrosion exhibited in Comparative Example 1.

EXAMPLE 1

A pad conditioner of the present invention was prepared and tested in the same manner as Comparative Example 2, except no electrical current was applied. After the test was allowed to run for about 16 hours, there was no corrosion apparent.

It is to be understood that even in the numerous characteristics and advantages of the present invention set forth in above description and examples, together with details of the structure and function of the invention, the disclosure is illustrative only. Changes can be made to detail, especially in matters of shape, size and arrangement of the electrically insulated pad conditioner and methods of use within the principles of the invention to the full extent indicated by the meaning of the terms in which the appended claims are expressed and the equivalents of those structures and methods.

What is claimed is:

1. A wafer planarization system comprising:

an electrical source having a first electrode and a second electrode;

a polishing pad carrier connected to said first electrode;

a workpiece carrier connected to said second electrode;

a conditioning tool comprising an abrasive surface adapted to condition said polishing pad; and an electrical insulator configured to isolate said abrasive surface from at least one of said first electrode and said second electrode;

wherein said conditioning tool comprises said electrical insulator; wherein said conditioning tool further comprises an electrically insulated conditioning disk comprising said abrasive surface and a substrate proximate said abrasive surface; and wherein said conditioning disk further comprises a carrier affixed to said substrate.

2. The system of claim 1 wherein said carrier is an electrical insulator.

3. The system of claim 2 wherein said carrier is formed from polycarbonate.

4. The system of claim 1 wherein said substrate is conductive.

5. The system of claim 4 wherein said substrate comprises nickel.

6. The system of claim 5 wherein said abrasive surface comprises a plurality of abrasive particles affixed to said substrate with a metal matrix.

7. The system of claim 6 wherein said abrasive particles comprise diamonds.

8. The system of claim 6 wherein said metal matrix comprises nickel.

9. A method of conditioning an electrochemical-mechanical polishing pad comprising:

electrically insulating an abrasive surface of a conditioning tool; wherein said conditioning tool comprises an electrically insulated conditioning disk comprising a substrate proximate said abrasive surface and a carrier affixed to said substrate;

contacting said abrasive surface with said polishing pad; and moving said abrasive surface relative to said polishing pad.

10. The method of claim 9 wherein said carrier is an electrical insulator.

11. The method of claim 10 wherein said carrier is formed from polycarbonate.

* * * * *

UNITED STATES PATENT AND TRADEMARK OFFICE

CERTIFICATE OF CORRECTION

PATENT NO. : 7,125,324 B2
APPLICATION NO. : 10/797890
DATED : October 24, 2006
INVENTOR(S) : Gary M. Palmgren It is certified that error appears in the above-identified patent and that said Letters Patent is hereby corrected as shown below:

Title Page, U.S Patent Documents, Column 2
After "6,517,424" delete "B1" and insert --B2--
After "6,648,731" delete "B1" and insert --B2--

Column 3
Line 33 delete "wafer." and insert --wafer--

Signed and Sealed this

Thirtieth Day of January, 2007

JON W. DUDAS
*Director of the United States Patent and Trademark Office*